US006048077A

United States Patent [19]

Pan

[11] Patent Number: 6,048,077

[45] Date of Patent: Apr. 11, 2000

[54] RETAINER MECHANISM USED IN DECORATIVE LIGHT BULB SOCKETS

[76] Inventor: Wun Fang Pan, No. 123, Lane 99, Pu Din Road, Hsinchu City, Taiwan

[21] Appl. No.: 09/114,163

[22] Filed: Jul. 13, 1998

[51] Int. Cl.[7] ..... F21V 21/00; F21P 1/02; A47G 1/10

[52] U.S. Cl. ..... 362/249; 362/123; 362/396; 248/316.1

[58] Field of Search ..... 362/249, 123, 362/396; 248/316.1, 316.7, 231.81

[56] References Cited

U.S. PATENT DOCUMENTS 1,888,723 11/1932 Gould ..... 362/249
5,791,765 8/1998 Lin ..... 362/249

*Primary Examiner*—Cassandra Spyrou
*Assistant Examiner*—Fayez Assaf
*Attorney, Agent, or Firm*—Rosenberg, Klein & Lee

[57] ABSTRACT

The invention relates to a retainer mechanism used for holding a net-type array of miniature light bulbs. The retainer mechanism includes a C-shaped loop adaptable for coupling with a miniature light bulb socket. The C-shaped loop is provided with a symmetrical hook portion on two sides of the C-shaped loop. The hook portion has a bulged outer end that, in cooperation with the inner end, forms an entirely embracing structure around electrical wires that pass through the hook portion. Thus the retainer mechanism according to the invention can effectively seize electrical wires. Furthermore, the retainer can be individually made and so it is applicable to current miniature light bulb sockets without any changes on the socket structure.

3 Claims, 5 Drawing Sheets

RETAINER MECHANISM USED IN DECORATIVE LIGHT BULB SOCKETS

BACKGROUND OF THE INVENTION

In a prior art structure of a net type array of decorative miniature light bulbs, the light bulb socket (1) is provided on two sides thereof with a symmetrical retainer loop (11) as shown in FIG. 1. The retainer loop can capture an electrical wire therein to form a net type array of light bulbs. The retainer loop (11) needs an additional processing to make it suitable for attachment to a light bulb socket (1). This provides inconvenience in manufacturing as well as poor association with sockets. Besides, the retainer loop (11) is a simple hook structure and thus can not prevent electrical wires from escaping when the electrical wires are pulled. Therefore, the structure can not provide dependable performance. It is desirable to have improvements on such a structure.

In view of the above problems, it is a primary object of the invention to provide a retainer mechanism used for a net type array of miniature light bulbs that mainly comprises an individual C-shaped loop that can be directly mounted over an outer cylindrical surface of a miniature light bulb socket and has two hook portions formed on the opposite sides thereof for seizing electrical wires. Now the structural features and other advantages of the invention will be explained below with reference to the accompanying drawings.

BRIEF DESCRIPTION OF THE ACCOMPANYING DRAWINGS.

DETAILED DESCRIPTION OF THE PREFERRED EMBODIMENTS

Figure 1:
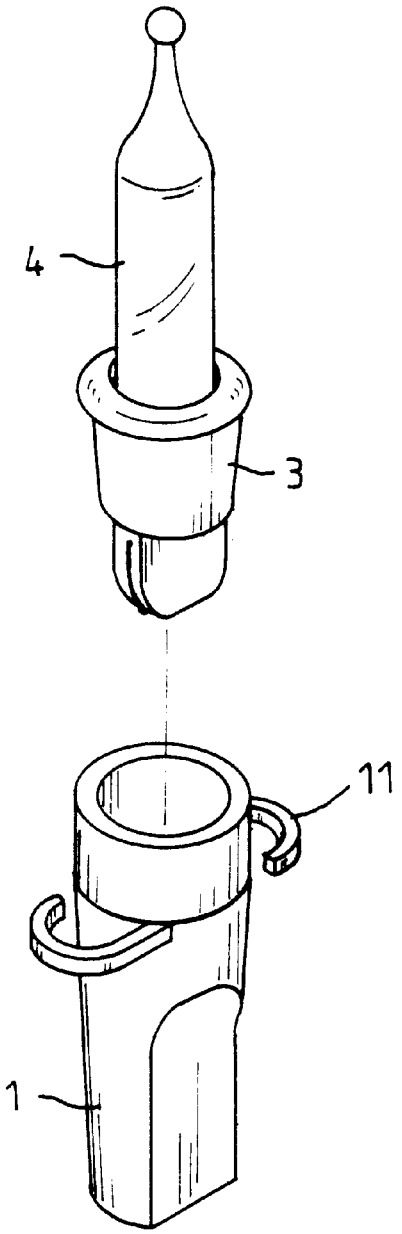
FIG. 1 (prior art)
FIG. 1 is an exploded view showing a prior art structure of a miniature light bulb socket assembly.
Figure 2:
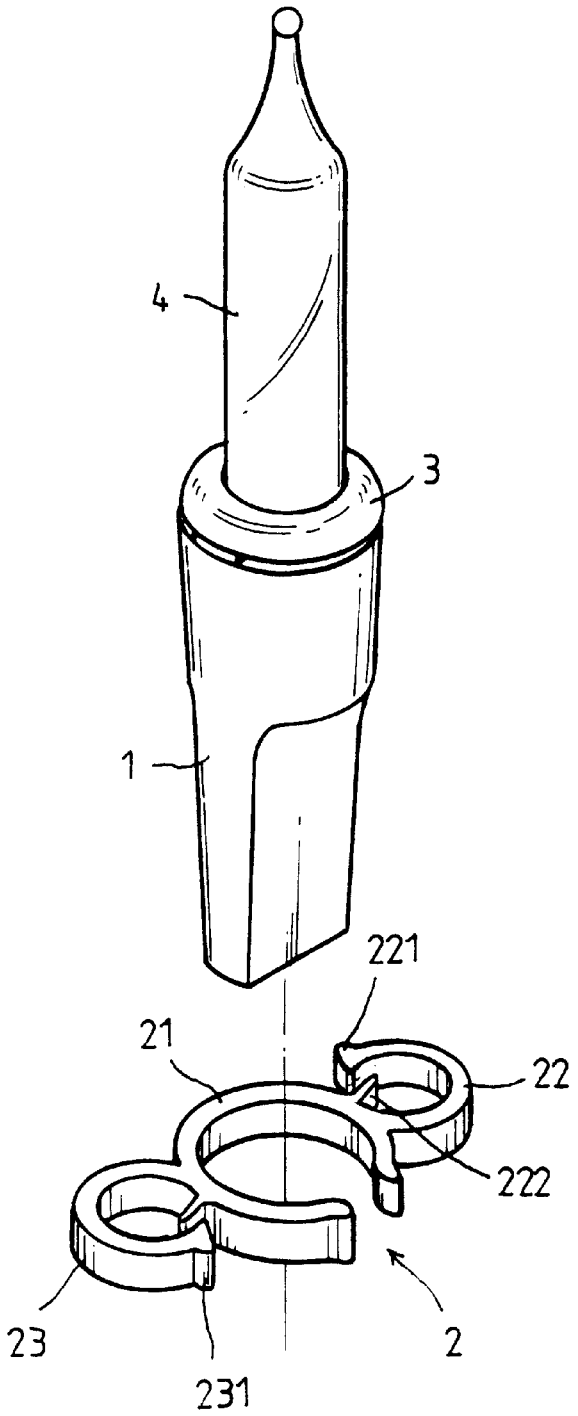
FIG. 2 is an exploded view of an embodiment of the retainer mechanism according to the invention.
Figure 3:
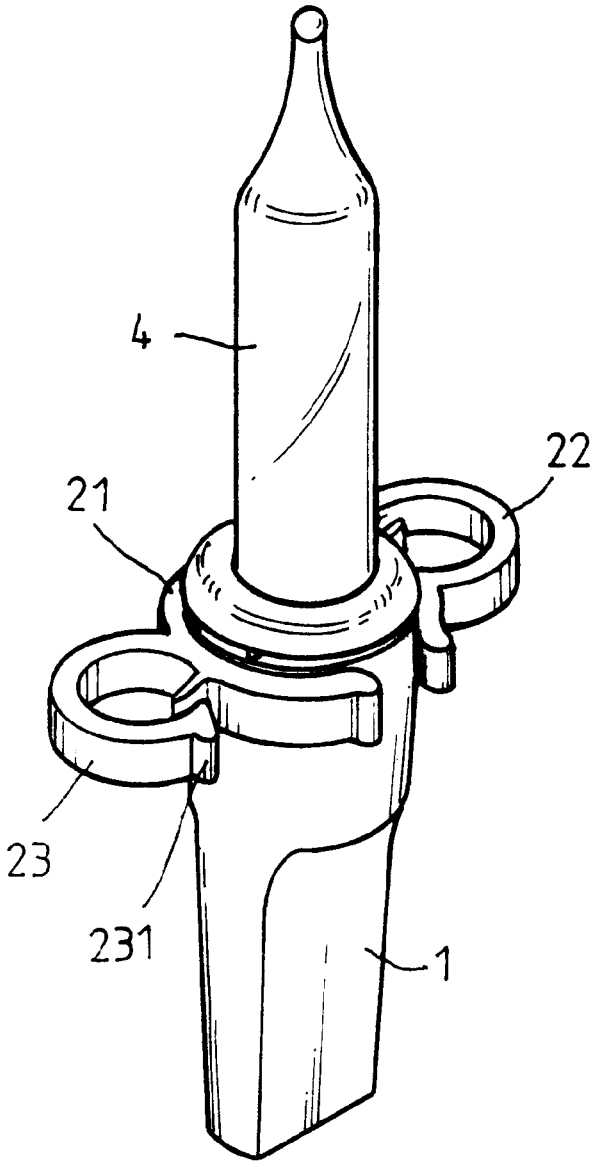
FIG. 3 is a perspective view depicting the retainer mechanism of the invention in an assembled state.
Figure 4:
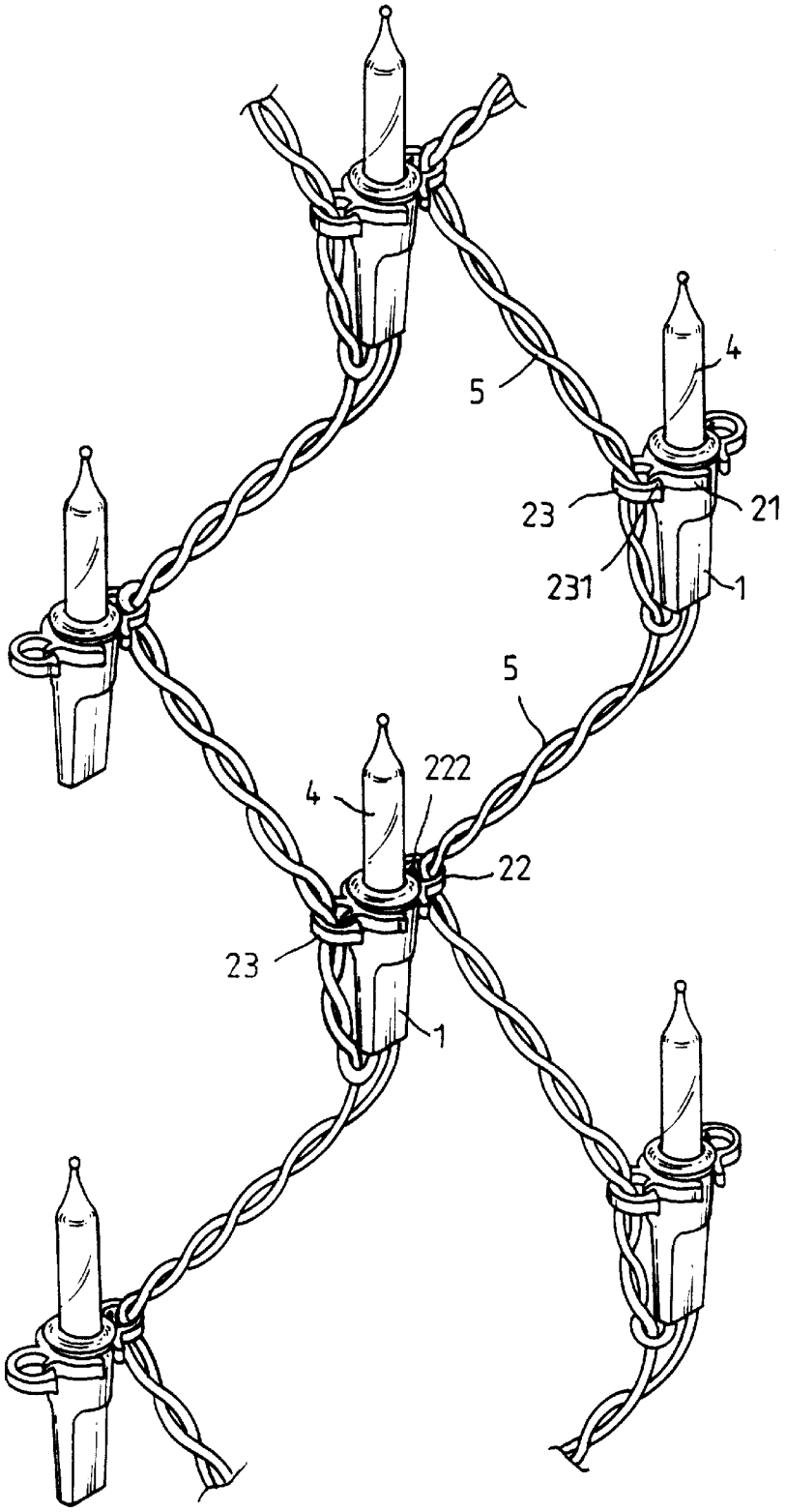
FIG. 4 illustrates the practice of the retainer mechanism of the invention.

In FIGS. 2 to 4, a retainer (2) according to the invention is shown. The retainer (2) is adaptable for coupling with a socket (1) and a holder (3) of a miniature light bulb (4). The main part of the retainer (2) is primarily a C-shaped loop (21). The C-shaped loop (21) is provided with a hook portion (22, 23) symmetrically formed on two opposite sides. The hook portions (22, 23) respectively have a bulged end (221, 231) that slightly extends over another end (222) to form a circle with overlapped ends. In the practice, the C-shaped loop (21) can directly mount over the outer cylindrical surface of a socket (1) in a simple way, with electrical wires (5) extending into the hook portions (22, 23). Thus the retainer of the invention can be easily connected to form a decorative light bulb net as shown in FIG. 4.

The invention uses an independent retainer (2) that can directly be combined with an average miniature light bulb with any further processing. Thus it can provide convenience in assembling. Furthermore, the retainer (2) can be integrally formed and thus it is simple in manufacturing. The invention is characterized in that of the hook portion is provided with a bulged outer end. When an electrical wire secured in the hook portion is pulled, the inner end (222) of the hook portion will be forced to abut against the bulged outer end so that the electrical wire is seized more firmly. Hence the invention can eliminate a conventional drawback of easily dropping electrical wires.

Figure 5:
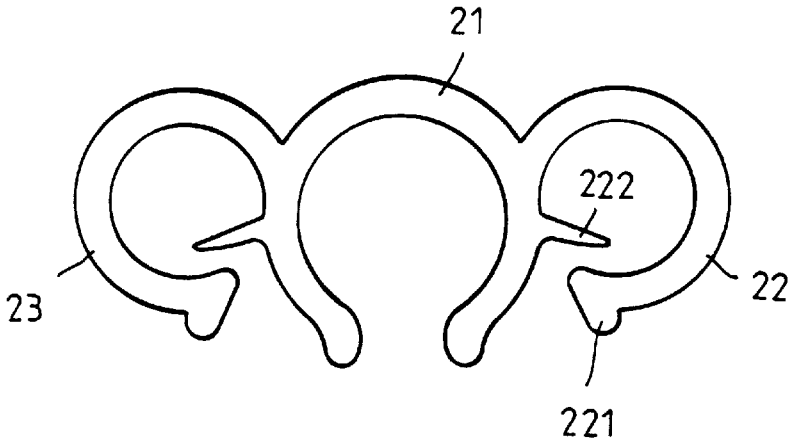
FIG. 5 shows a variation of the retainer mechanism according to the invention.
Figure 6:
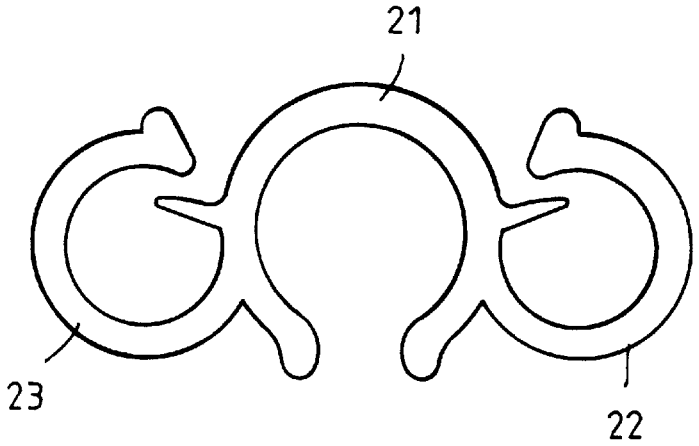
FIG. 6 shows another variation of the retainer mechanism according to the invention.

As shown in FIGS. 2 through 4, the hook portions of the retainer according to the invention respectively have an opening. The two openings face toward a direction opposite to each other. However, it has the same effect if the openings have the same orientation as the opening of the C-shaped loop as shown in FIG. 5, or have the same orientation that is opposite to the opening direction of the C-shaped loop as shown in FIG. 6. The above description only contains a few examples of the embodiment of the invention. It is apparent to the skilled person that many changes and modifications may be made without departing from the spirit and scope of the invention as defined in the claims.

What is claimed is:

1. A retainer mechanism for coupling a light bulb unit into a net-type array formed by an array of light bulb units supported by a multiplicity of electrical wires, each of said light bulb units including a light bulb, a socket having an outer surface and electrical wires extending from the socket, said retainer mechanism comprising:

a C-shaped loop removably engaged on the outer surface of the socket of the light bulb unit; and at least a pair of hook portions co-planar with and integrally joined to said C-shaped loop in one piece formation and spaced apart relationship, each said hook being formed by an extended wall circumscribing an opening, at least one of said hook portions embracing a plurality of the electrical wires of the net-type array, each said hook portion having (a) an inner end portion integrally formed with said C-shaped loop, and (b) an outer bulged end portion formed at a distal end of said extended wall and disposed in overlapping relationship with said inner end portion thereof, thereby forming said opening as a substantially closed contour embracing the plurality of electrical wires extending through said hook portion and securely holding the electrical wires therewithin, said extended wall being resiliently displaceable to admit the electrical wires into said opening.

2. The retainer mechanism as claimed in claim 1, wherein said C-shaped loop has an opening formed between opposing ends thereof, and wherein each of said hook portions has a respective open passage formed between said overlapped outer bulged end and said inner end, said respective open passage of each of said hook portions being oriented in the same direction as said opening of said C-shaped loop.

3. The retainer mechanism as claimed in claim 1, wherein said C-shaped loop has an opening formed between opposing ends thereof, and wherein each of said hook portions has a respective open passage formed between said overlapped outer bulged end and said inner end, said respective open passage of each of said hook portions being oriented in a direction opposite to that of said opening of said C-shaped loop.

* * * * *